United States Patent [19]

Demoures et al.

[11] 4,293,431

[45] Oct. 6, 1981

[54] PROCESS OF PREPARING METALLIC DETERGENT-DISPERSANT ADDITIVES OF HIGH ALKALINITY IN PARTICULAR FOR LUBRICATING OILS, AND PRODUCT OBTAINED THEREBY

[75] Inventors: Bernard Demoures, Puteaux; Jean-Louis Le Coent, Le Havre, both of France

[73] Assignee: Orogil, Courbevoie, France

[21] Appl. No.: 49,959

[22] Filed: Jun. 19, 1979

[30] Foreign Application Priority Data

Jun. 26, 1978 [FR] France ..... 78 18946

[51] Int. Cl.[3] ..... C10M 1/40

[52] U.S. Cl. ..... 252/33.2; 252/18; 252/42.7; 252/39; 252/40.7

[58] Field of Search ..... 252/33.2, 33, 18, 42.7, 252/39, 40.7

[56] References Cited

U.S. PATENT DOCUMENTS

| | | | |
|---|---|---|---|
| 3,178,368 | 4/1965 | Hanneman | 252/33.4 |
| 3,493,516 | 2/1970 | Allphin, Jr. et al. | 252/33.3 |
| 3,629,109 | 12/1971 | Gergel et al. | 252/33.2 |
| 4,049,560 | 9/1977 | Dominey | 252/33.2 |
| 4,057,504 | 11/1977 | Shiga et al. | 252/33 |

*Primary Examiner*—Jacqueline V. Howard

*Attorney, Agent, or Firm*—Herbert F. Schwartz; Ronald A. Schapira

[57] ABSTRACT

A process of preparing metallic detergent-dispersant compositions is provided by:

1. Reacting sulfur with an alkylphenol, bearing one or more $C_6$–$C_{60}$ alkyl substituents, in the presence of a dilution oil, an alkaline-earth metal alkylbenzene sulfonate of a molecular weight of more than about 300 and a TBN of less than or equal to about 150, an alkaline-earth metal compound, optionally an alkaline-metal hydroxide, a base component of metallic detergent-dispersant of a TBN greater than or equal to 200 selected from among superalkalinized sulfurized alkaline-earth metal alkylphenates, alkaline-earth metal alkylbenzene sulfonates, and mixtures of superalkalinized sulfurized alkaline earth metal alkylphenates and alkaline-earth metal alkylbenzene sulfonates, and an alkylene glycol, at a temperature of between 100° C. and 190° C.;
2. Carbonating the resultant mixture with carbon dioxide at a temperature of between 100° C. and 200° C., the amount of $CO_2$ being between that which can be completely absorbed and an excess of 30 percent of said amount;
3. Removing the alkylene glycol; and
4. Separating the metallic detergent-dispersant of high alkalinity thus obtained.

The detergent-dispersants thus obtained are useful in improving the detergent-dispersant power of lubricating oils.

18 Claims, No Drawings

PROCESS OF PREPARING METALLIC DETERGENT-DISPERSANT ADDITIVES OF HIGH ALKALINITY IN PARTICULAR FOR LUBRICATING OILS, AND PRODUCT OBTAINED THEREBY

BACKGROUND OF THE INVENTION

The present invention is directed to an improved process of preparing metallic detergent-dispersant additives of high alkalinity, in particular, for lubricating oils, and to the additives and lubricating oils containing the additives.

French Pat. No. 1,356,763 discloses that basic sulfurized alkylphenates can be prepared by sulfurizing an alkylphenol in the presence of a metallic sulfonate, a $C_8$–$C_{18}$ monoalcohol, an alkaline-earth metal base and ethylene glycol; followed by carbonation with carbon dioxide. Such a process has the drawback of requiring relatively large amounts of ethylene glycol and, furthermore, the presence of a monoalcohol.

By the present invention, an improved process has been provided which does not have the drawbacks of the prior art for obtaining metallic detergent-dispersant additives of a TBN (Total Basic Number, ASTM Standard D 2896) greater than 200, and to do so in a simple and rapid manner in the presence of a monoalcohol being required.

It is, therefore, an object of the present invention to provide novel detergent-dispersant compositions useful as additives for lubricating oils having a base of alkylbenzene sulfonates and alkylphenates.

It is also an object of the present invention to provide a novel process for the preparation of detergent-dispersants for use in lubricating oils.

It is also an object of the present invention to provide lubricating oils containing the novel additives of the invention.

Other objects of the present invention will be apparent to those skilled in the art from the present description.

GENERAL DESCRIPTION OF THE INVENTION

The improved process of preparing metallic detergent-dispersant compositions from alkaline-earth metal alkylbenzene sulfonates, alkylphenols, an alkaline-earth metal base compound, an alkylene glycol, and carbon dioxide comprises:

(1) reacting sulfur with an alkylphenol bearing one or more $C_6$–$C_{60}$ alkyl substituents in the presence of a dilution oil, an alkaline-earth metal alkylbenzene sulfonate of a molecular weight of more than about 300 and a TBN less than or equal to about 150, an alkaline earth compound, optionally an alkaline metal hydroxide, a base component of a metallic detergent-dispersant of a TBN greater than or equal to about 200 selected from among superalkalinized sulfurized alkylphenates of alkaline earth metals and mixtures of superalkalinized sulfurized alkylphenates of alkaline earth metals and alkaline-earth metal alkylbenzene sulfonates, and an alkylene glycol, at a temperature of between about 100° C. and 190° C. The process employs the following reagents in the following quantities:

(a) at least about 5 parts by weight of alkylphenol for 100 parts by weight of mixture of alkylphenol plus alkylbenzene sulfonate;

(b) up to about 95 parts by weight of alkylbenzene sulfonate for 100 parts by weight of mixture of alkylphenol plus alkylbenzene sulfonate;

(c) from about 1 to 18 parts by weight of sulfur for 100 parts by weight of mixture of alkylphenol plus alkylbenzene sulfonate;

(d) from about 4 to 45 parts by weight of alkaline-earth compound for 100 parts by weight of mixture of alkylphenol plus alkylbenzene sulfonate;

(e) up to about 10 parts by weight of alkaline metal hydroxide for 100 parts by weight of mixture of alkylphenol plus alkylbenzene sulfonate;

(f) from about 2 to 35 parts by weight of base component for 100 parts by weight of mixture of alkylphenol plus alkylbenzene sulfonate; and, (g) from about 8 to 200 parts by weight of alkylene glycol for 100 parts by weight of mixture of alkylphenol plus alkylbenzene sulfonate;

(2) optimally, continuing the sulfurization operation by heating at a higher temperature within the range of between about 100° C. and 190° C.;

(3) carbonating the resultant mixture by means of carbon dioxide at a temperature of between about 100° C. and 200° C., the amount of $CO_2$ being between that which can be completely absorbed and an excess of 30 percent of said amount;

(4) removing the alkylene glycol; and (5) separating the metallic detergent-dispersant composition of high alkalinity thus obtained.

By "alkylbenzene sulfonate" as used herein is meant any solution containing from about 40 to 95 percent by weight, and preferably about 55 to 85 percent by weight, of an alkylbenzene sulfonate in a dilution oil, which may or may not be the same as that used to carry out the process forming the object of the invention.

In the preferred aspects of the invention:

(1) the sulfurization step is carried out with an alkylbenzene sulfonate of a TBN less than or equal to about 50 at a temperature of between about 120° C. and 180° C. at a pressure less than or equal to atmospheric pressure, with the following amounts of reagents:

(a) from about 10 to 60 parts by weight of alkylphenol for 100 parts by weight of mixture of alkylphenol plus alkylbenzene sulfonate;

(b) from about 40 to 90 parts by weight of alkylbenzene sulfonate for 100 parts by weight of mixture of alkylphenol plus alkylbenzene sulfonate;

(c) from about 2 to 12 parts by weight of sulfur for 100 parts by weight of mixture of alkylphenol plus alkylbenzene sulfonate;

(d) from about 6 to 40 parts by weight of alkaline earth compound for 100 parts by weight of mixture of alkylphenol plus alkylbenzene sulfonate;

(e) up to about 8 parts by weight of alkaline-metal hydroxide for 100 parts by weight of mixture of alkylphenol plus alkylbenzene sulfonate;

(f) from about 3 to 20 parts by weight of base component for 100 parts by weight of mixture of alkylphenol plus alkylbenzene sulfonate; and (g) from about 10 to 50 parts by weight of alkylene glycol for 100 parts by weight of mixture of alkylphenol plus alkylbenzene sulfonate.

(2) the optimal additional sulfurization step is carried out at a higher temperature of between about 130° C. and 185° C. at a pressure less than or equal to atmospheric pressure;

(3) the carbonation step is carried out at a temperature between about 100° C. and 185° C., with the use of an amount of $CO_2$ which is substantially equal to that which can be completely absorbed.

Among the alkylphenols which can be used for the practice of the process of the invention are preferably those having one or more $C_9$–$C_{15}$ alkyl substituents and, in particular, the nonyl, decyl, dodecyl, and tetradecyl phenols.

Among the alkylbenzene sulfonates which can be used are the sulfonic acid salts (of a molecular weight preferably greater than about 400), whether natural, obtained by sulfonation of petroleum cuts, or synthetic, obtained by sulfonation of alkylbenzenes derived from olefins or polymers of olefins of $C_{15}$–$C_{30}$, and alkaline-earth metals such as calcium, barium, magnesium, etc.

The alkaline-earth compound to be used may be formed of oxides or hydroxides of calcium, barium, magnesium, etc., alone or in mixture. The metal from which the alkaline-earth alkylbenzene sulfonate used is derived may or may not be the same as that or those contained in the alkaline-earth compound. Among the alkali metal hydroxides which can be used, mention may be made of sodium, lithium, and potassium hydroxides.

Among the dilution oils which can be used, mention may be made, preferably, of paraffin oils, such as 100 Neutral oil, etc.; naphthene or mixed oils can also be used. The amount of dilution oil which can be used is such that the amount of oil contained in the final product (including that coming from the initial alkylbenzene sulfonate) represents from about 20 to 60 percent by weight of the said product, and preferably about 25 to 55 percent, of the said product.

A variant of the process of the invention comprises preparing the alkaline-earth metal alkylbenzene sulfonate "in situ", prior to the sulfurization-neutralization stage, by action of an oxide or hydroxide of said alkaline-earth metal on an alkylbenzene sulfonic acid, such as defined above, in the presence of oil and alkylene glycol possibly, at a temperature of between about 40° C. and 110° C., the amount of alkaline-earth metal oxide or hydroxide and of oil to be used being such that the alkylbenzene sulfonate obtained has a TBN less than or equal to about 150, and preferably less than or equal to about 50.

The process of the invention is of very particular interest for preparing detergent-dispersants of a TBN greater than or equal to about 250 and having a large percentage by weight of calcium or barium (at least 10 percent).

The said process can be carried out starting from a calcium and/or barium alkylbenzene sulfonate with the following specific quantities of reagents:

(a) from about 15 to 45 parts by weight, and preferably 18 to 40 parts, by weight, of calcium or barium hydroxide as alkaline-earth compound for 100 parts by weight of mixture of alkylphenol plus calcium and/or barium alkylbenzene sulfonate;

(b) from about 2 to 35 parts by weight, and preferably about 3 to 18 parts by weight, of base component of a TBN greater than or equal to about 250, formed of a calcium and/or barium sulfurized, carbonated alkylphenate and/or a calcium and/or a barium carbonated alkylbenzene sulfonate for 100 parts by weight of a mixture of alkylphenol plus calcium and/or barium alkylbenzene sulfonate;

(c) from about 6 to 30 parts by weight, and preferably about 10 to 20 parts by weight, of alkylene glycol for 100 parts by weight of mixture of alkylphenol and calcium and/or barium alkylbenzene sulfonate.

The process of the invention is also of interest for the preparation of detergent-dispersant compositions of a TBN greater than about 200 and containing at least about 2 percent by weight of magnesium and possibly at least about 0.5 percent by weight of calcium.

The process, in one aspect, consists in using:

(a) a magnesium and/or calcium alkylbenzene sulfonate as alkaline-earth metal alkylbenzene sulfonate;

(b) a mixture of magnesium oxide and calcium hydroxide as alkaline-earth compound or of magnesium compound as alkaline-earth compound in mixture with an alkaline metal hydroxide;

(c) a base component formed of a magnesium and/or calcium carbonated alkylbenzene sulfonate and/or a magnesium and/or calcium sulfurized carbonated alkylphenate of a TBN greater than or equal to about 200 and optimally in treating the medium at any stage whatsoever of the carbonation step with 0 to about 10 percent by weight, and preferably 0 to about 5 percent by weight, of water, referred to the weight of the said reaction medium.

Although any type of magnesium oxide can be used, "active" magnesium oxide is, however, preferred. By "active" magnesium oxide is meant magnesium oxide (MgO) of a specific surface greater than or equal to about 80 $m^2/g$., for instance, between 100 and 170 $m^2/g$. By way of example, mention may be made of the "Maglite DE" of a specific surface of close to 140 $m^2/g$., marketed by Merck, and of "Ferumag" of a specific surface of close to 160 $m^2/g$., marketed by Rhone-Poulenc Industries.

For a satisfactory carrying out of this process, the following particular amounts of reagents may be used:

(a) from about 4 to 40 parts, and preferably about 5 to 30 parts, by weight of alkaline-earth compound for 100 parts of mixture of alkylphenol plus magnesium and/or calcium alkylbenzene sulfonate;

(b) from about 4 to 25 parts, and preferably, about 5 to 20 parts, by weight of magnesium oxide for 100 parts of mixture of alkylphenol plus magnesium and/or calcium alkylbenzene sulfonate;

(c) up to about 25 parts, and preferably up to about 18 parts, by weight of calcium hydroxide for 100 parts of mixture of alkylphenol plus magnesium and/or calcium alkylbenzene sulfonate;

(d) up to about 10 parts, and preferably from about 0.1 to 8 parts, of alkaline metal hydroxide for 100 parts of mixture of alkylphenol plus magnesium and/or calcium alkylbenzene sulfonate;

(e) from about 8 to 200 parts, and preferably from about 10 to 50 parts, of alkylene glycol for 100 parts of mixture of alkylphenol plus magnesium and/or calcium alkylbenzene sulfonate;

(f) from about 2 to 25 parts, and preferably, from about 10 to 20 parts of base component, for 100 parts of mixture of alkylphenol plus magnesium and/or calcium alkylbenzene sulfonate.

Another object of the present invention are the detergent-dispersant compositions or additives of high alkalinity obtained by the process of the invention. They have the advantage of good compatibility with viscous oils, as well as a very low sediment content. They can be added to lubricating oils in quantities which are a function of the TBN of the said detergent-dispersant additives and a function of the future use of said oils. Thus, for a gasoline-engine oil, the amount of detergent-dispersants of a TBN of between 200 and 300, for instance, to be added is generally between about 1 and 3.5 percent; for a diesel engine oil it is generally between about 1.8 and 5 percent, and for a marine engine oil it may range up to about 25 percent.

The lubricating oils which can thus be improved can be selected from among a very large number of lubricating oils such as lubricating oils of naphthene base, paraffin base and mixed base, other hydrocarbon lubricants, for instance, lubricating oils derived from coal products and synthetic oils, for instance, alkylene polymers, polymers of the alkylene oxide type and their derivatives, including the alkylene oxide polymers prepared by polymerizing alkylene oxide in the presence of water or alcohols, for instance, ethyl alcohol, the dicarboxylic acid esters, liquid esters of phosphorus acids, alkylbenzenes and dialkylbenzenes, polyphenyls, alkylbiphenyl ethers, and polymers of silicon.

Additional additives can also be present in the said lubricating oils in addition to the detergent-dispersant additives of the invention. Mention may be made, for instance, of antioxidants, anti corrosives, ash-less dispersing additives, etc.

SPECIFIC DESCRIPTION OF THE INVENTION

In order to disclose more clearly the nature of the present invention, the following examples illustrating the invention are given. It should be understood, however, that this is done solely by way of example and is intended neither to delineate the scope of the invention nor limit the ambit of the appended claims. In the examples which follow, and throughout the specification, the quantities of material are expressed in terms of parts by weight, unless otherwise specified.

EXAMPLES 1 to 4

The general method of preparation (4 phases) of the superalkalinized detergent-dispersants forming the object of Examples 1 to 4 are described below and the quantities of reagents necessary for their preparation are indicated in Tables I and I(a), below.

1st phase (sulfurization)

There are introduced into a 4-liter, four-neck reactor provided with an agitator system and a heating device, dodecylphenol (DDP), 100 N oil, a solution of about 60 percent in 100 n dilution oil of a calcium alkylbenzene sulfonate (Ca sulfonate) of a molecular weight of about 470 (weight of the sodium salt), said solution containing 2.7 percent of calcium and having a TBN of about 25, a methylpolysiloxane agent marketed by Rhone-Poulenc Industries under the designation "SI 200," a base component formed of a mixture of superalkalinized detergents of a TBN of 260, having a base of sulfurized superalkalinized calcium dodecylphenate and superalkalinized calcium alkylbenzene sulfonate of a molecular weight of about 470.

Lime and sulfur are then introduced with agitation. The medium is brought to 145° C. under slight vacuum, whereupon ethylene glycol is added over 80 minutes, while heating at 165° C., and this temperature is maintained for 1 hour under a slight vacuum in order to completely eliminate the water of reaction coming from the neutralization of the lime and to prolong the sulfurization.

The water eliminated always carries with it a small amount of glycol.

2nd phase (carbonation)

After having readjusted the amount of glycol to its original value, a carbonation operation is carried out by means of carbon dioxide at 165° C. to 170° C., at atmospheric pressure, until the end of the absorption of $CO_2$. This phase lasts about $1\frac{1}{2}$ hours. The viscosity of the medium drops rapidly at the start of this phase and then becomes stable.

Water is eliminated, entraining a small amount of glycol with it.

3rd phase (elimination of the glycol)

The medium is brought to a temperature of 184° C. at 20 mm. mercury for 1 hour.

4th phase (filtration)

The medium is filtered to remove the sediments and there is recovered a solution in 100 N oil of superalkalinized detergent-dispersant, which is degasified and the characteristics of which are set forth in Table I(a), below.

The operation took a total of 10 hours.

TABLE I

| Examples | 1 | 2 | 3 | 4 |
|---|---|---|---|---|
| 1st phase | | | | |
| DDP, g | 509 | 339 | 254 | 169.5 |
| Ca sulfonate, g. | 564 | 929 | 1073 | 1216.5 |
| DDP/Ca sulfonate by weight | 47/53 | 27/73 | 19/81 | 12/88 |
| oil, g. | 442.5 | 253 | 190 | 126.5 |
| SI 200, cc. | 0.2 | 0.4 | 0.4 | 0.4 |
| base component, g. | 160 | 160 | 160 | 160 |
| TBN | 260 | 260 | 260 | 260 |
| phenate/sulfonate by weight | 60/40 | 40/60 | 30/70 | 20/80 |
| lime, g. | 376.5 | 375 | 373.5 | 370.5 |
| sulfur, g. | 85.5 | 59.5 | 44.5 | 29.5 |
| glycol, g. | 181 | 180 | 179 | 178 |

TABLE I(a)

| Examples | 1 | 2 | 3 | 4 |
|---|---|---|---|---|
| 2nd phase | | | | |
| $Co_2$, g. | 135 | 135 | 134.5 | 133.2 |
| weight of distillate collected in g. (water + glycol) in the 1st and 2nd phases | 90 | 89 | 86 | 85 |
| 3rd phase | | | | |
| glycol distilled in g. | 127 | 127 | 129 | 130 |
| % sediment | 0.8 | 0.8 | 1 | 2 |
| weight of detergent-dispersant solution | 2142 | 2140 | 2140 | 2117 |
| Analysis of the solution | | | | |
| % Ca | 9.9 | 10.7 | 11.0 | 10.8 |
| TBN | 257 | 269 | 272 | 270 |
| appearance | bright | bright | bright | slightly cloudy |
| compatibility at 10% in a mineral oil appearance of the solution | | | | slightly cloudy |
| % sediment | 0.03 | 0.06 | 0.08 | 0.15 |

EXAMPLES 5 to 8

The operations described in Examples 1 to 4 are carried out under the same conditions, starting with a 60 percent solution in 100 N oil of a calcium alkylbenzene sulfonate of a molecular weight of about 470, said solution containing 3.4 percent calcium and having a TBN of about 45.

Furthermore, the products obtained in Examples 1 through 4, respectively, are used as base components, respectively, in these Examples 5 to 8.

The amounts of reagents used and the characteristics of the products obtained are set forth in Tables II and II(a), below.

TABLE II

| Examples | 5 | 6 | 7 | 8 |
|---|---|---|---|---|
| 1st phase | | | | |
| DDP, g. | 509 | 339 | 254 | 169.5 |
| Ca sulfonate, g. | 564 | 929 | 1073 | 1216.5 |
| DDP/Ca sulfonate by weight | 47/53 | 27/73 | 19/81 | 12/88 |
| oil, g. | 442.5 | 253 | 190 | 126.5 |
| SI 200, cc. | 0.2 | 0.4 | 0.4 | 0.4 |
| base component, g. | 160 | 160 | 160 | 160 |
| TBN | 257 | 269 | 272 | 270 |
| phenate/sulfonate by weight | 60/40 | 40/60 | 30/70 | 20/80 |
| (product of the example) | 1 | 2 | 3 | 4 |
| lime, g. | 369 | 363 | 359.5 | 354.5 |
| sulfur, g. | 85.5 | 59.5 | 44.5 | 29.5 |
| glycol, g. | 177 | 174 | 172.5 | 170 |

TABLE II(a)

| Examples | 5 | 6 | 7 | 8 |
|---|---|---|---|---|
| 2nd phase | | | | |
| $Co_2$, g. | 133 | 131 | 130 | 128 |
| weight of distillate collected in g. (water + glycol) in the 1st and 2nd phases | 88 | 84 | 83 | 82 |
| 3rd phase | | | | |
| glycol distilled in g. | 124 | 125 | 123 | 122 |
| % sediment | 0.8 | 0.8 | 1 | 2 |
| weight of detergent-dispersant solution | 2146 | 2140 | 2140 | 2177 |
| Analysis of the solution | | | | |
| % Ca | 9.9 | 10.7 | 11.0 | 10.8 |
| TBN | 257 | 269 | 272 | 270 |
| appearance | bright | bright | bright | slightly cloudy |
| compatibility at 10% in a mineral oil (appearance of the solution | clear | clear | clear | slightly cloudy |
| % sediment | 0.03 | 0.06 | 0.08 | 0.15 |

EXAMPLES 9 to 12

The operations described in Examples 1 to 4 are carried out under the same conditions, starting with a 60 percent solution in 100 N oil of a neutral calcium alkylbenzene sulfonate of a molecular weight of about 470, the solution containing 1.8 percent calcium and having a TBN of zero.

The products obtained in Examples 1 to 4, or 5 to 8, respectively, are used as base components in these Examples 9 to 12, respectively.

The amounts of reagents used and the characteristics of the products obtained are set forth in Tables III and III(a), below.

TABLE III

| Examples | 9 | 10 | 11 | 12 |
|---|---|---|---|---|
| 1st phase | | | | |
| DDP, g. | 509 | 339 | 254 | 169.5 |
| Ca sulfonate, g. | 564 | 929 | 1073 | 1216.5 |
| DDP/Ca sulfonate by weight | 47/53 | 27/73 | 19/81 | 12/88 |
| oil, g. | 442.5 | 253 | 190 | 126.5 |
| SI 200, cc. | 0.2 | 0.4 | 0.4 | 0.4 |
| base component, g. | 160 | 160 | 160 | 160 |
| TBN | 257 | 269 | 272 | 270 |
| phenate/sulfonate by weight | 60/40 | 40/60 | 30/70 | 20/80 |
| (product of the example) | 1 or 5 | 2 or 6 | 4 or 7 | 4 or 8 |
| lime, g. | 385.5 | 390 | 392 | 390.5 |
| sulfur, g. | 85.5 | 59.5 | 44.5 | 29.5 |
| glycol, g. | 185 | 197 | 188 | 187 |

TABLE III(a)

| Examples | 9 | 10 | 11 | 12 |
|---|---|---|---|---|
| 2nd phase | | | | |
| $CO_2$, g. | 139 | 140 | 141 | 140 |
| weight of distillate collected in g. (water + glycol) in the 1st and 2nd phases | 92 | 93 | 94 | 93 |
| 3rd phase | | | | |
| glycol distilled in g. | 130 | 131 | 133 | 131 |
| % sediment | 0.8 | 0.8 | 1 | 2 |
| weight of detergent-dispersant solution | 2156 | 2145 | 2156 | 2136 |
| Analysis of the solution | | | | |
| % Ca | 9.9 | 10.7 | 11.0 | 10.8 |
| TBN | 257 | 269 | 272 | 270 |
| appearance | bright | bright | bright | slightly cloudy |
| compatibility at 10% in a mineral oil (appearance of the solution) | clear | clear | clear | slightly cloudy |
| % sediment | 0.03 | 0.06 | 0.08 | 0.15 |

EXAMPLES 13 to 16

The operations described in Examples 1 to 4 are carried out under the same conditions, starting with an 80 percent solution in 100 N oil of a calcium alkylbenzene sulfonate of a molecular weight of about 470, said solution containing 3.37 percent of calcium and having a TBN of 33.

The products obtained in Examples 1 to 4, Examples 5 to 8, or Examples 9 to 12, respectively, are used as base component in these Examples 13 to 16.

The amounts of reagents used and the characteristics of the products obtained appear from Tables IV and IV(a), below.

TABLE IV

| Examples | 13 | 14 | 15 | 16 |
|---|---|---|---|---|
| 1st phase | | | | |
| DDP, g. | 509 | 339 | 254 | 169.5 |
| Ca sulfonate, g. | 451 | 743 | 858 | 973 |
| DDP/Ca sulfonate by weight | 53/47 | 31/69 | 23/77 | 15/85 |
| oil, g. | 505 | 389 | 355 | 319.5 |
| SI 200, cc. | 0.2 | 0.4 | 0.4 | 0.4 |
| base component, g. | 160 | 160 | 160 | 160 |
| TBN | 257 | 269 | 272 | 270 |
| phenate/sulfonate by weight | 60/40 | 40/60 | 30/70 | 20/80 |
| (product of the example) | 1, 5 or 9 | 2, 6 or 10 | 3, 7 or 11 | 4, 8 or 12 |
| lime, g. | 376.5 | 375 | 373.5 | 370.5 |
| sulfur, g. | 85.5 | 59.5 | 44.5 | 29.5 |

TABLE IV-continued

| Examples | 13 | 14 | 15 | 16 |
|---|---|---|---|---|
| glycol, g. | 181 | 180 | 179 | 178 |

TABLE IV(a)

| Examples | 13 | 14 | 15 | 16 |
|---|---|---|---|---|
| 2nd phase | | | | |
| $CO_2$, g. | 135 | 135 | 134.5 | 133.2 |
| weight of distillate collected in g. (water + glycol) in the 1st and 2nd phases | 90 | 89 | 86 | 85 |
| 3rd phase | | | | |
| glycol distilled in g. | 127 | 127 | 129 | 130 |
| % sediment | 0.8 | 0.8 | 1 | 2 |
| weight of detergent-dispersant solution | 2142 | 2130 | 2110 | 2086 |
| Analysis of the solution | | | | |
| % Ca | 9.9 | 10.8 | 11.2 | 11.0 |
| TBN | 257 | 270 | 273 | 272 |
| appearance | bright | bright | bright | slightly cloudy |
| compatibility at 10% in a mineral oil (appearance of the solution) | clear | clear | clear | slightly cloudy |
| % sediment | 0.04 | 0.07 | 0.1 | 0.2 |

EXAMPLE 17

The operation described in Example 2 is carried out, replacing the calcium sulfonate solution by an approximately 60 percent solution in 100 N oil of a magnesium alkylbenzene sulfonate (Mg sulfonate) of a molecular weight of about 470, said solution containing 1.5 percent of magnesium and having a TBN of about 20, in order to obtain a detergent-dispersant containing calcium and magnesium.

The sediment used is formed of one of the products prepared in Examples 2, 6, 10, or 14, respectively.

The amounts of reagents used and the characteristics of the products obtained appear in Tables V and V(a), below.

TABLE V

| Example | 17 |
|---|---|
| 1st phase | |
| DDP, g. | 339 |
| Mg sulfonate, g. | 929 |
| DDP/Mg sulfonate by weight | 27/73 |
| oil, g. | 253 |
| SI 200, cc. | 0.4 |
| base component, g. | 160 |
| TBN | 269–270 |
| Ca phenate/Ca sulfonate by weight | 40/60 |
| (product of the example) | 6, 10 or 14 |
| lime, g. | 330 |
| sulfur, g. | 59.5 |
| glycol, g. | 158 |

TABLE V(a)

| Example | 17 |
|---|---|
| 2nd phase | |
| $CO_2$, g. | 119 |
| weight of distillate collected in g. (water + glycol) in the 1st and 2nd phases | 75 |
| 3rd phase | |
| glycol distilled in g. | 115 |
| % sediment | 1 |

TABLE V(a)-continued

| Example | 17 |
|---|---|
| weight of detergent-dispersant solution | 2100 |
| Analysis of the solution | |
| % Ca | 9.0 |
| % Mg | 0.81 |
| TBN | 262 |
| Appearance | bright |
| Compatability at 10% in a mineral oil (appearance of the solution) | clear |
| % sediment | 0.06 |

EXAMPLE 18

The operation described in Example 6 is carried out modifying the manner of procedure as follows:

the sulfurization phase is carried out at 155° C. at atmospheric pressure in the presence of 175 g. of ethylene glycol and 35 g. of $C_{10}$ oxo alcohol (i.e., 20 percent of the weight of glycol) followed by a dehydration stage at 180° C. at atmospheric pressure.

The characteristics of the product obtained are similar to those of the product of Example 6, above.

EXAMPLE 19

The operation described in Example 6 is carried out with the sulfurization step being carried out at 170° C. at atmospheric pressure for 1 hour. The subsequent dehydration stage is then superfluous.

The characteristics of the product obtained are similar to those of the product of Example 6, above.

EXAMPLE 20

The operation described in Example 6 is carried out with the following change in the manner of procedure:

the sulfurization stage is carried out at 145° C. at atmospheric pressure in the presence of 175 g. of glycol and 35 g. of hexanol (namely, 20 percent of the weight of glycol) followed by a dehydration stage at 150° C. at atmospheric pressure.

The characteristics of the product obtained are similar to those of the product of Example 6.

EXAMPLE 21

The operation described in Example 6 is carried out with the following change in the manner of operation:

the sulfurization phase is carried out at 155° C. at 580 mm. mercury pressure in the presence of 200 g. of glycol, followed by a dehydration phase at 145° C. at 400 mm. mercury pressure. The characteristics of the product are similar to those of the product of Example 6.

EXAMPLE 22

The operation described in Example 6 is carried out under 40 g. of base component instead of 160 g. There is found a somewhat higher viscosity of the medium after sulfurization and a slightly lower rate of filtration.

The characteristics of the product obtained are similar to those of the product of Example 6, above.

EXAMPLE 23

The operation described in Example 6 is carried out using 203 g. of base component instead of 160 g.

The characteristics of the product obtained are similar to those of the product of Example 6.

EXAMPLE 24

The operation described in Example 6 is carried out using 152 g. of glycol instead of 174 g.

The characteristics of the product obtained are similar to those of the product of Example 6.

EXAMPLE 25

The operation described in Example 6 is carried out using 230 g. of glycol instead of 174 g.

The characteristics of the product obtained are similar to those of the product of Example 6.

EXAMPLE 26

The operation is carried out similar to that described in Example 6 using 160 g. of a base component formed of sulfurized superalkalinized calcium dodecyl phenate of a TBN of 200, instead of a mixture of sulfurized dodecyl phenate and alkylbenzene sulfonate of a TBN of 260.

The amounts of reagents used and the characteristics of the product obtained are set forth in Tables VI and VI(a), below.

TABLE VI

| Example | 26 |
|---|---|
| 1st phase | |
| DDP, g. | 339 |
| Ca sulfonate, g. | 929 |
| DDP/Ca sulfonate by weight | 27/73 |
| oil, g. | 253 |
| SI 200. cc. | 0.4 |
| base component, g. | 160 |
| TBN | 200 |
| lime, g. | 369 |
| sulfur, g. | 59.5 |
| glycol, g. | 177 |

TABLE VI(a)

| EXAMPLE | 26 |
|---|---|
| 2nd phase | |
| $CO_2$, g. | 134 |
| weight of distillate collected in g. (water + glycol) in the 1st and 2nd phases | 85 |
| 3rd phase | |
| glycol distilled in g. | 127 |
| % sediment | 2 |
| weight of detergent-dispersant solution | 2141 |
| Analysis of the solution | |
| % Ca | 10.7 |
| TBN | 269 |
| Appearance | bright |
| Compatibility at 10% in a mineral oil (appearance of the solution | clear |
| % sediment | 0.06 |

EXAMPLE 27

The operation described in Example 6 is carried out using a base component formed of calcium alkylbenzene sulfonate of a TBN of 260 instead of a mixture of sulfurized dodecyl phenate and alkylbenzene sulfonate of a TBN of 260.

The characteristics of the product obtained are similar to those of Example 6, as well as the amounts of reagents used.

EXAMPLE 28 to 37

The general method of preparing superalkalinized detergent-dispersants containing at least 2 percent magnesium which form the object of Examples 28 to 37 is described below and the amounts of reagents necessary for their preparation are set forth in Tables VII and VIII, below.

1st phase (sulfurization)

Into a 4-liter, four-neck reactor provided with an agitator system and a heating device there are introduced: dodecyl phenol (DDP), 100 N oil, an approximately 60 percent solution in 100 N dilution oil of a magnesium alkylbenzene sulfonate (Mg sulfonate) of a molecular weight of about 470, said solution containing 1.8 percent of magnesium and having a TBN of about 25, an antifoam marketed by Rhone-Poulenc under the name SI 200, a base component formed of a mixture of superalkalinized detergent-dispersants, having a base of a sulfurized superalkalinized calcium dodecyl phenate and a superalkalinized magnesium alkylbenzene sulfonate of a molecular weight of about 470.

"Maglite DE," lime, and sulfur are introduced with agitation. The medium is brought to 145° C. under a slight vacuum, whereupon glycol is added in 1 hour while heating at 165° C. This temperature is maintained for 1 hour under a slight vacuum.

2nd phase (carbonation)

The amount of glycol is returned to its original value and a carbonation operation is carried out with the use of carbon dioxide at 165° C. for 7 hours. Cooling is effected at 110° C. for 1 hour and 30 minutes.

3rd phase (elimination of the glycol)

The glycol is removed as in the previous examples.

4th phase (filtration)

This phase is carried out in the same manner as in the preceding examples.

The amounts of materials and properties are set forth in Tables VII, VII(a), VIII and VIII(a), below.

TABLE VII

| Examples | 28 | 29 | 30 | 31 | 32 |
|---|---|---|---|---|---|
| 1st phase | | | | | |
| DDP, g. | 467 | 239 | 479 | 267 | 339 |
| Mg sulfonate, g. | 450 | 425 | 449 | 733 | 929 |
| DDP/sulfonate by weight | 51/49 | 36/64 | 52/48 | 37/73 | 27/73 |
| oil, g. | 687 | 465 | 698 | 278 | 353 |
| SI 200, cc. | 0.4 | 0.9 | 1.3 | 1 | 1 |
| base component, g. | 157 | 109 | 160 | 140 | 150 |
| TBN | 200 | 220 | 220 | 230 | 230 |
| phenate/sulfonate by weight | 55/45 | 58/42 | 58/42 | 40/60 | 40/60 |
| lime, g. | 124 | 63 | 127 | 16 | 20 |
| MgO, g. | 88 | 83 | 88 | 120 | 160 |
| sulfur, g. | 81 | 39 | 78 | 47 | 59 |
| glycol, g. | 480 | 220 | 120 | 400 | 250 |

TABLE VII(a)

| Examples | 28 | 29 | 30 | 31 | 32 |
|---|---|---|---|---|---|
| 2nd phase | | | | | |

TABLE VII(a)-continued

| Examples | 28 | 29 | 30 | 31 | 32 |
|---|---|---|---|---|---|
| $CO_2$, g. | 132 | 97 | 135 | 140 | 140 |
| water, g. | 50 | 50 | 50 | 50 | 50 |
| weight of distillate collected in the 1st and 2nd phases | 90 | 50 | 25 | 70 | 60 |
| 3rd phase | | | | | |
| glycol distilled in g. | 330 | 120 | 70 | 290 | 130 |
| % sediment | 3 | 2 | 2 | 2 | 3 |
| weight of detergent-dispersant solution | 1988 | 1400 | 2000 | 1565 | 1961 |
| Analysis of the solution | | | | | |
| % Mg | 2.2 | 3.64 | 2.68 | 5 | 5.3 |
| % Ca | 3.2 | 2.39 | 3.29 | 0.5 | 0.55 |
| TBN | 200 | 221 | 211 | 229 | 233 |
| Appearance | bright | bright | bright | bright | bright |
| Compatibility at 10% in a mineral oil (appearance of the solution) | clear | clear | clear | clear | clear |
| % sediment | 0.02 | 0.06 | 0.03 | 0.07 | 0.08 |

TABLE VIII

| Examples | 33 | 34 | 35 | 36 | 37 |
|---|---|---|---|---|---|
| 1st phase | | | | | |
| DDP, g. | 406 | 546 | 504 | 504 | 467 |
| Mg sulfonate, g. | 1000 | 588 | 514 | 652 | 360 |
| DDP/sulfonate by weight | 29/71 | 48/52 | 54/46 | 44/56 | 56/44 |
| oil, g. | 380 | 501 | 556 | 472 | 777 |
| SI 200, cc. | 1 | 1 | 1 | 1 | 0.4 |
| base component, g. | 160 | 120 | 130 | 100 | 157 |
| TBN | 200 | 260 | 240 | 266 | 200 |
| phenate/sulfonate by weight | 45/55 | 58/42 | 64/36 | 54/46 | 45/55 |
| lime, g. | 116 | 130 | 144 | 116 | 124 |
| MgO, g. | 69 | 116 | 100 | 152 | 88 |
| sulfur, g. | 70 | 94 | 102 | 88 | 81 |
| glycol, g. | 200 | 300 | 300 | 400 | 480 |

TABLE VIII(a)

| Examples | 33 | 34 | 35 | 36 | 37 |
|---|---|---|---|---|---|
| 2nd phase | | | | | |
| $CO_2$, g. | 140 | 160 | 150 | 180 | 132 |
| water, g. | 50 | 50 | 50 | 50 | 50 |
| weight of distillate collected in the 1st and 2nd phases | 50 | 50 | 60 | 70 | 90 |
| 3rd phase | | | | | |
| glycol distilled in g. | 100 | 180 | 180 | 290 | 330 |
| % sediment | 1 | 1.5 | 1.5 | 1.5 | 3 |
| weight of detergent-dispersant solution | 2160 | 2120 | 2130 | 2100 | 1990 |
| Analysis of the solution | | | | | |
| % Mg | 2.9 | 3.9 | 3.4 | 4.34 | 2.3 |
| % Ca | 3 | 3.2 | 3.5 | 3 | 3.1 |
| TBN | 200 | 260 | 240 | 266 | 200 |
| Appearance | bright | bright | bright | bright | bright |
| Compatibility at 10% in a mineral oil (appearance of the solution) | clear | clear | clear | clear | clear |
| % sediment | 0.03 | 0.06 | 0.06 | 0.07 | 0.02 |

EXAMPLE 38

The operation described in Example 28 is repeated, the sulfurization stage being carried out at 180° C.

The characteristics of the product obtained are similar to those of the product of Example 28.

EXAMPLE 39

The operation described in Example 28 is repeated, the carbonation stage being carried out at 145° C.

The characteristics of the product obtained are similar to those of the product of Example 28.

EXAMPLE 40

The operation described in Example 28 is carried out, starting with a magnesium alkylbenzene sulfonate in 60 percent solution having a TBN of 45 and a magnesium content of 2.2 percent.

The amounts of reagents used and the characteristics of the products obtained are set forth in Tables IX and IX(a), below.

EXAMPLE 41

The operation described in Example 29 is repeated, the sulfurization operation being carried out in the presence of glycol and tridecyl alcohol.

The amounts of reagents used and the characteristics of the products obtained appear in Tables IX and IX(a), below.

EXAMPLE 42

The operation described in Example 28 is repeated, the sulfurization stage being carried out with the use of a base component formed of a superalkalinized magnesium alkylbenzene sulfonate of a TBN of 200.

The quantities of reagents used and the characteristics of the products obtained appear in Tables IX and IX(a), below.

EXAMPLE 43

The operation described in Example 28 is repeated, using a superalkalinized calcium dodecyl phenate of a TBN of 200 as base component.

The amounts of reagents used and the characteristics of the products obtained are set forth in Tables IX and IX(a), below.

TABLE IX

| Examples | 40 | 41 | 42 | 43 |
|---|---|---|---|---|
| 1st phase | | | | |
| DDP, g. | 467 | 239 | 467 | 467 |
| Mg sulfonate, g. | 450 | 425 | 450 | 450 |
| DDP/sulfonate by weight | 51/49 | 36/64 | 51/49 | 51/49 |
| oil, g. | 687 | 465 | 687 | 687 |
| SI 200, cc. | 0.4 | 0.9 | 0.4 | 0.4 |
| base component | 157 | 109 | 157 | 157 |
| TBN | 200 | 220 | 200 | 200 |
| phenate/sulfonate by weight | 55/45 | 58/42 | 0/100 | 100/0 |
| lime, g. | 120 | 63.3 | 124 | 124 |
| MgO, g. | 88 | 83 | 88 | 88 |
| sulfur, g. | 81 | 39 | 81 | 81 |
| glycol, g. | 470 | 120 | 470 | 480 |
| tridecyl alcohol, g. | 0 | 100 | 0 | 0 |

TABLE IX(a)

| Examples | 40 | 41 | 42 | 43 |
|---|---|---|---|---|
| 2nd phase | | | | |
| $CO_2$, g. | 130 | 97 | 130 | 132 |
| water, g. | 50 | 50 | 50 | 50 |
| weight of distillate collected in the 1st and 2nd phases | 90 | 60 | 90 | 90 |
| 3rd phase | | | | |
| glycol distilled in g. | 320 | 110 | 320 | 330 |
| % sediment | 3 | 1 | 3 | 3 |
| weight of detergent-dispersant solution | 1988 | 1400 | 1985 | 1988 |
| Analysis of the solution | | | | |
| % Mg | 2.4 | 3.8 | 2.2 | 2.1 |
| % Ca | 3.2 | 2.4 | 3.2 | 3.3 |
| TBN | 204 | 230 | 200 | 200 |
| Appearance | bright | bright | bright | bright |
| Compatibility at 10% in a mineral oil (appearance of the solution) | clear | clear | clear | clear |
| % sediment | 0.02 | 0.06 | 0.02 | 0.02 |

EXAMPLE 44

The operation described in Example 32 is carried out, the 20 g. of lime being replaced by 10 g. of caustic soda; the characteristics of the product obtained are equivalent to those of the product of Example 32.

EXAMPLE 45

The operation described in Example 28 is carried out without introducing water during the course of the carbonation operation. The characteristics of the product obtained are equivalent to those of the product of Example 28.

Sediment Content

The percentages of sediment appearing in the foregoing tables were measured in accordance with ASTM Standard D 2273-67, with, however, the following changes:

speed of rotation of the centrifuge, 6,000 rpm;

relative centrifugal force, 10,000;

the product to be analyzed is diluted to one-quarter in E gasoline (25 cc. of product to be analyzed plus 75 cc. of E gasoline);

time of centrifuging: 10 minutes.

Compatibility

The compatibility tests appearing in the tables given above were carried out by addition of 10 percent by weight of product to be tested to an SAE 30 mineral oil, storage of the solution obtained for one month at 20° C., and study of the appearance of the solution as a function of time.

COMPARISON WITH COMMERCIAL PRODUCTS

Test with the additive alone

The product of Example 33 is added to an SAE 50 oil having a paraffin trend so as to obtain a solution containing 125 millimoles of calcium plus magnesium. The solution is stored for 15 days at 20° C. It is noted that the solution remains clear.

The same test is carried out with a mixture of:

magnesium alkylbenzene sulfonate of a TBN of 400;

calcium alkylbenzene sulfonate of a TBN of 25;

calcium alkylphenate of a TBN of 150; in such amount that the solution obtained contains 125 millimoles of calcium plus magnesium.

After 15 days of storage at 20° C., the solution is cloudy and flocculant.

Test with the additive in formulation

A mixture (A) of additives is prepared containing:

2 percent of a dispersant having a base of polyisobutenylsuccinimide;

1.6 millimole of a zinc dithiophosphate; and 2.3 percent of the product of Example 33.

This mixture is kept for 25 days at 80° C. and then added to an SAE 30 oil so as to have a concentration of 6.6 percent by weight of mixture (A).

The solution is stored for 5 days at 80° C.

This same test is carried out with a mixture (B) formed of:

2 percent of a dispersant having a base of polyisobutenylsuccinimide;

1.6 millimol of zinc dithiophosphate; and 2.3 percent of a mixture formed of:

magnesium alkylbenzene sulfonate of a TBN of 400;

calcium alkylbenzene sulfonate of a TBN of 25;

calcium alkylphenate of a TBN of 150; having a number of millimoles of calcium plus magnesium equivalent to that of the product of Example 33.

It is noted that the solution containing the mixture (A) is clearer and brighter than that containing mixture (B).

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A process of preparing metallic detergent-dispersant compositions from alkylbenzene sulfonates of alkaline earth metals, alkylphenols, and alkaline earth compound, an alkylene glycol and carbon dioxide, which process comprises:

(1) reacting sulfur with an alkylphenol bearing at least one $C_6$–$C_{60}$ alkyl substituent in the presence of a dilution oil, an alkaline earth metal alkylbenzene sulfonate of a molecular weight greater than about 300 and TBN less than or equal to about 150, an alkaline earth metal compound, optionally an alkali metal hydroxide, a base component of a metallic detergent-dispersant of a TBN greater than or equal to about 200 selected from among superalkalinized and sulfurized alkaline earth metal alkylphenates, alkylbenzene sulfonates of alkaline earth metals and mixtures of superalkalinized sulfurized alkylphenates of alkaline earth mixtures and alkylbenzene sulfonates of alkaline earth metals, and an alkylene glycol, at a temperature of between about 100 and 190° C., employing the following quantities of reagents:

(a) at least about 5 parts by weight of alkylphenol for 100 parts by weight of mixture of alkylphenol plus alkylbenzene sulfonate;

(b) up to about 95 parts by weight of alkylbenzene sulfonate for 100 parts by weight of mixture of alkylphenol plus alkylbenzene sulfonate;

(c) from about 1 to 18 parts by weight of sulfur for 100 parts by weight of mixture of alkylphenol plus alkylbenzene sulfonate;

(d) from about 4 to 45 parts by weight of alkaline earth compound for 100 parts by weight of mixture of alkylphenol plus alkylbenzene sulfonate;

(e) up to about 10 parts by weight of alkali metal hydroxide for 100 parts by weight of mixture of alkylphenol plus alkylbenzene sulfonate;

(f) from about 2 to 35 parts by weight of said base component for 100 parts by weight of mixture of alkylphenol plus alkylbenzene sulfonate; and (g) from about 8 to 200 parts by weight of alkylene glycol for 100 parts by weight of mixture of alkylphenol plus alkylbenzene sulfonate.

(2) carbonating the resultant mixture by means of carbon dioxide at a temperature of between about 100 and 200° C., the amount of $CO_2$ being between that which can be completely absorbed and an excess of 30% of said amount;

(3) removing the alkylene glycol; and (4) separating the metallic detergent-dispersant of high alkalinity thus obtained.

2. A process according to claim 1, wherein the sulfurization step is continued by heating to a higher temperature of between 100° and 190° C.

3. A process according to claim 1, wherein:

(A) the sulfurization state is carried out on the basis of an alkylbenzene sulfonate of a TBN less than or equal to about 50 at a temperature between about 120° and 180° C., at a pressure less than or equal to atmospheric pressure, with the following amounts of reagents:

(a) from about 10 to 60 parts by weight of alkylphenol for 100 parts by weight of mixture of alkylphenol plus alkylbenzene sulfonate;

(b) from about 40 to 90 parts by weight of alkylbenzene sulfonate for 100 parts by weight of mixture of alkylphenol plus alkylbenzene sulfonate;

(c) from about 2 to 12 parts by weight of sulfur for 100 parts by weight of mixture of alkylphenol plus alkylbenzene sulfonate;

(d) from about 6 to 40 parts by weight of alkaline-earth compound for 100 parts by weight of mixture of alkylphenol plus alkylbenzene sulfonate;

(e) up to about 8 parts by weight of alkali metal hydroxide for 100 parts by weight of mixture of alkylphenol plus alkylbenzene sulfonate;

(f) from about 3 to 20 parts by weight of base component for 100 parts by weight of mixture of alkylphenol plus alkylbenzene sulfonate; and, (g) from about 10 to 50 parts of weight of alkylene glycol for 100 parts by weight of mixture of alkylphenol plus alkylbenzene sulfonate;

(B) the carbonation step is carried out at a temperature of between about 100° and 185° C. by means of an amount of $CO_2$ substantially equal to that which can be completely absorbed.

4. The process according to claim 2 wherein the sulfurization step is carried out at a higher temperature of between 130° and 185° C. at a pressure less than or equal to atmospheric pressure.

5. A process according to claim 1 or claim 3, wherein the alkylphenol used contains at least one $C_9$–$C_{15}$ alkyl substituent.

6. A process according to claim 1 or claim 3, wherein the alkylbenzene sulfonate is a member selected from calcium, barium, and magnesium salts of a sulfonic acid of a molecular weight of more than 400, either natural obtained by sulfonation of petroleum cuts, or synthetic obtained by sulfonation of alkylbenzenes derived from olefins or polymers of olefins of $C_{15}$–$C_{30}$.

7. A process according to claim 1 or claim 3, wherein the alkaline-earth metal compound is formed of a member selected from oxides and hydroxides of calcium, barium, and magnesium, alone and then in mixtures.

8. A process according to claim 1 or claim 3, wherein the alkali-metal hydroxide consists of a member selected from sodium, lithium, and potassium hydroxides.

9. A process according to claim 1 or claim 3, wherein the alkylene glycol is ethylene glycol.

10. A process according to claims 1, or 3, wherein the alkylene glycol is present in mixture with up to about 200% of its weight of a monoalcohol of a boiling point of more than 120° C.

11. A process according to any of claims 1, or 3, wherein the alkaline earth components are derivatives of calcium or barium and the sulfurization step is carried out in the presence of the following quantities of reagents:

(a) at least about 5 parts by weight of alkylphenol for 100 parts by weight of mixture of alkylphenol plus calcium and/or barium alkylbenzene sulfonate;

(b) up to about 95 parts by weight of calcium or barium alkylbenzene sulfonate for 100 parts by weight of mixture of alkylphenol plus calcium and/or barium alkylbenzene sulfonate;

(c) from about 15 to 45 parts by weight of calcium or barium hydroxide as alkaline earth compound for 100 parts by weight of mixture of alkylphenol plus calcium and/or barium alkylbenzene sufonate;

(d) from about 2 to 35 parts by weight of base component of a TBN greater than or equal to about 250 formed of a sulfurized, carbonated alkylphenate of calcium and/or barium for 100 parts by weight of mixture of alkylphenol plus calcium and/or barium alkylbenzene sulfonate; and (e) from about 6 to 30 parts by weight of alkylene glycol for 100 parts by weight of mixture of alkylphenol plus calcium and/or barium alkylbenzene sulfonate.

12. A process according to claim 11, wherein the sulfurization step is carried out in the presence of the following amounts of reagents:

(a) from about 10 to 60 parts by weight of alkylphenol for 100 parts by weight of mixture of alkylphenol plus calcium and/or barium alkylbenzene sulfonate;

(b) from about 40 to 90 parts by weight of calcium and/or barium alkylbenzene sulfonate for 100 parts by weight of mixture of alkylphenol plus calcium and/or barium alkylbenzene sulfonate;

(c) from about 18 to 40 parts by weight of calcium or barium hydroxide as alkaline earth compound for 100 parts by weight of mixture of alkylphenol plus calcium and/or barium alkylbenzene sulfonate;

(d) from about 3 to 18 parts by weight of a base component of a TBN greater than or equal to about 250 formed of a calcium and/or barium sulfurized carbonated alkylphenate and/or a calcium and/or barium carbonated alkylbenzene sulfonate for 100 parts by weight of mixture of alkylphenol plus calcium and/or barium alkylbenzene sulfonate;

(e) from about 10 to 20 parts by weight of alkylene glycol for 100 parts by weight of mixture of alkylphenol plus calcium and/or barium alkylbenzene sulfonate.

13. A process according to any of claims 1 to 4, wherein the alkaline earth components are derivatives of magnesium and/or calcium and the sulfurization step is carried out in the presence of a mixture of magnesium oxide and calcium hydroxide as alkaline earth compound or magnesium oxide as alkaline earth compound mixed with an alkali metal hydroxide, in the presence of the following amounts of reagents:

(a) at least about 5 parts by weight of alkylphenol for 100 parts by weight of mixture of alkylphenol plus magnesium and/or calcium alkylbenzene sulfonate;

(b) up to about 95 parts by weight of magnesium and/or calcium alkylbenzene sulfonate for 100 parts by weight of mixture of alkylphenol plus magnesium and/or calcium alkylbenzene sulfonate;

(c) from about 4 to 40 parts by weight of alkaline earth compound for 100 parts by weight of mixture of alkylphenol plus magnesium and/or calcium alkylbenzene sulfonate;

(d) from about 4 to 25 parts by weight of magnesium oxide for 100 parts by weight of mixture of alkylphenol plus magnesium and/or calcium alkylbenzene sulfonate;

(e) up to about 25 parts by weight of calcium hydroxide for 100 parts of mixture of alkylphenol plus magnesium and/or calcium alkylbenzene sulfonate;

(f) up to about 10 parts by weight of alkaline metal hydroxide for 100 parts of mixture of alkylphenol plus magnesium and/or calcium alkylbenzene sulfonate;

(g) from about 8 to 200 parts of alkylene glycol for 100 parts of mixture of alkylphenol plus magnesium and/or calcium alkylbenzene sulfonate;

(h) from about 2 to 25 parts for 100 parts of mixture of alkylphenol plus magnesium and/or calcium alkylbenzene sulfonate of a basic component formed of a magnesium and/or calcium carbonated alkylbenzene sulfonate and/or a magnesium and/or calcium sulfurized carbonated alkylphenate of a TBN of greater than or equal to 200, and by treating the medium at any stage of the carbonation step with 0 to 10% by weight of water referred to the weight of the said reaction medium.

14. A process according to claim 13, wherein the sulfurization step is carried out in the presence of the following quantities of reagents:

(a) from about 10 to 60 parts by weight of alkylphenol for 100 parts by weight of mixture of alkylphenol plus magnesium and/or calcium alkylbenzene sulfonate;

(b) from about 40 to 90 parts by weight of calcium and/or magnesium alkylbenzene sulfonate for 100 parts by weight of mixture of alkylphenol plus magnesium and/or calcium alkylbenzene sulfonate;

(c) from about 5 to 30 parts by weight of alkaline earth compound for 100 parts of mixture of alkylphenol plus magnesium and/or calcium alkylbenzene sulfonate;

(d) from about 5 to 20 parts by weight of magnesium oxide for 100 parts of mixture of alkylphenol plus magnesium and/or calcium alkylbenzene sulfonate;

(e) up to about 18 parts by weight of calcium hydroxide for 100 parts of mixture of alkylphenol plus magnesium and/or calcium alkylbenzene sulfonate;

(f) from about 0.1 to 8 parts of alkali metal hydroxide for 100 parts of mixture of alkylphenol plus magnesium and/or calcium alkylbenzene sulfonate;

(g) from about 10 to 50 parts of alkylene glycol for 100 parts of mixture of alkylphenol plus magnesium and/or calcium alkylbenzene sulfonate;

(h) from about 10 to 20 parts of a base component for 100 parts of mixture of alkylphenol plus magnesium and/or calcium alkylbenzene sulfonate and by treating the medium at any stage of the carbonation step with 0 to 5% by weight of water, referred to the weight of the said reaction medium.

15. A detergent-dispersant additive for lubricating oils, obtained by the process defined by any of claims 1 to 4.

16. A novel lubricating composition, having desirable detergent and dispersion properties, comprising an oil containing up to about 25 percent by weight of a novel lubricant additive according to claim 15.

17. A gasoline engine oil, having desirable detergent and dispersion properties, containing between about 1 and 3.5 percent by weight of a novel lubricant additive according to claim 15.

18. A novel diesel engine oil having desirable detergent and dispersion properties containing between about 1.8 and 5 percent by weight of a novel lubricant additive according to claim 15.

* * * * *

UNITED STATES PATENT AND TRADEMARK OFFICE

CERTIFICATE OF CORRECTION

PATENT NO. : 4,293,431

DATED : Demoures et al.

INVENTOR(S) : October 6, 1981

It is certified that error appears in the above—identified patent and that said Letters Patent is hereby corrected as shown below:

Column 6, line 43, replace "$Co_2$" with -- $CO_2$ -- ;

Column 6, line 62, insert -- clear -- in columns 1, 2 and 3 of Table I(a);

Column 7, line 42, replace "2177" with -- 2117 -- in column 8 of Table II(a).

Signed and Sealed this

*Twentieth* Day of *April 1982*

[SEAL]

*Attest:*

GERALD J. MOSSINGHOFF

*Attesting Officer*

*Commissioner of Patents and Trademarks*